US008511385B2

(12) United States Patent
Sørenson et al.

(10) Patent No.: US 8,511,385 B2
(45) Date of Patent: Aug. 20, 2013

(54) WELL APPARATUS

(75) Inventors: Bjørn Bro Sørenson, Sandefjord (NO); Jan-Erik Totland, Sandefjord (NO)

(73) Assignee: Agility Projects AS, Sandefjord (NO)

( * ) Notice: Subject to any disclaimer, the term of this patent is extended or adjusted under 35 U.S.C. 154(b) by 288 days.

(21) Appl. No.: 12/666,393

(22) PCT Filed: Jun. 26, 2008

(86) PCT No.: PCT/GB2008/002193

§ 371 (c)(1),
(2), (4) Date: Sep. 1, 2010

(87) PCT Pub. No.: WO2009/001088

PCT Pub. Date: Dec. 31, 2008

(65) Prior Publication Data

US 2010/0314121 A1 Dec. 16, 2010

Related U.S. Application Data

(60) Provisional application No. 60/929,410, filed on Jun. 26, 2007.

(30) Foreign Application Priority Data

Jun. 26, 2007 (GB) ..... 0712426.6
Jul. 10, 2007 (GB) ..... 0713382.0

(51) Int. Cl.
*E21B 7/12* (2006.01)

(52) U.S. Cl.
USPC ..... 166/339; 166/342; 166/343; 166/360

(58) Field of Classification Search
USPC ..... 166/339, 342, 343, 360; 114/256, 114/257, 263, 258, 268, 44, 49–53
See application file for complete search history.

(56) References Cited

U.S. PATENT DOCUMENTS 3,749,162 A * 7/1973 Anders ..... 166/354
3,771,481 A * 11/1973 Goren et al. ..... 114/265

(Continued)

FOREIGN PATENT DOCUMENTS

GB 2418684 A 4/2006
JP 7-229383 A 8/1995

(Continued)

OTHER PUBLICATIONS

Search Report of UK IP Office Regarding British Patent Application No. GB0712426.6, Apr. 7, 2008.

(Continued)

*Primary Examiner* — Matthew Buck
*Assistant Examiner* — Aaron Lembo
(74) *Attorney, Agent, or Firm* — Bacon & Thomas, PLLC

(57) ABSTRACT

Well apparatus comprises a tower, and a support for supporting well intervention, completion, testing, or drilling equipment, the support being attached to the tower and being movable laterally from a parked position on the tower, where preparation of the equipment can be carried out without occupying an operational area where the equipment is to operate on the well, and an operational position in the operational area, and the support being arranged to be lowered or lifted, the apparatus further comprising a guide mechanism for guiding the support so that as the support is - lowered or lifted it is guided along a path involving lateral movement from the parked position to the operational position in the operational area.

22 Claims, 9 Drawing Sheets

(56) References Cited

U.S. PATENT DOCUMENTS

| | | | | |
|---|---|---|---|---|
| RE29,478 | E * | 11/1977 | Goren et al. | 114/265 |
| 4,208,158 | A | 6/1980 | Davies et al. | |
| 4,650,637 | A * | 3/1987 | Chubb | 376/253 |
| 4,952,118 | A * | 8/1990 | Macmillan | 414/788.2 |
| 6,032,744 | A | 3/2000 | Burge et al. | |
| 6,161,619 | A * | 12/2000 | Head | 166/355 |
| 6,217,258 | B1 | 4/2001 | Yamamoto et al. | |
| 6,901,998 | B1 * | 6/2005 | Roodenburg et al. | 166/85.1 |
| 6,932,553 | B1 | 8/2005 | Roodenburg et al. | |
| 7,152,672 | B1 | 12/2006 | Gipson | |
| 2002/0074125 | A1 | 6/2002 | Fikes et al. | |
| 2003/0098150 | A1 | 5/2003 | Andreychuk | |
| 2003/0111232 | A1 | 6/2003 | Welsh et al. | |
| 2004/0089215 | A1 | 5/2004 | Roodenburg et al. | |
| 2004/0206551 | A1 | 10/2004 | Carriere et al. | |
| 2006/0104747 | A1 | 5/2006 | Zahn et al. | |
| 2006/0289171 | A1 | 12/2006 | Wood et al. | |
| 2007/0125551 | A1 | 6/2007 | Havinga | |
| 2009/0151955 | A1 * | 6/2009 | Bamford et al. | 166/335 |
| 2010/0293781 | A1 * | 11/2010 | Foo et al. | 29/791 |

FOREIGN PATENT DOCUMENTS

| | | | |
|---|---|---|---|
| WO | 99/27222 | A1 | 6/1999 |
| WO | 00/11305 | A1 | 3/2000 |
| WO | 2004/020275 | A2 | 3/2004 |
| WO | 2007/061747 | A1 | 5/2007 |

OTHER PUBLICATIONS

Search Report of UK IP Office Regarding British Patent Application No. GB0811750.9, Jul. 31, 2008.

Examination Report of UK IP Office Regarding British Patent Application No. GB0811750.9, Oct. 8, 2009.

Search Report of UK IP Office Regarding British Patent Application No. GB0712426.6, Oct. 22, 2007.

International Search Report in PCT/GB2008/002193, Oct. 15, 2008.

* cited by examiner

WELL APPARATUS

FIELD OF THE INVENTION

The invention relates to methods and apparatus for well intervention, completion, testing, or drilling, and to methods and apparatus for transferring a load to an operational area where the load is to operate on the well. The apparatus and methods are applicable to operations involving ships, rigs, or platforms, for example.

BACKGROUND

In oil and gas drilling operations there are various techniques for inserting or removing tubing or pipes or lines into or from wells. Well intervention techniques include the use of coiled tubing, wirelines or a process where individual pipe sections are screwed together to form a continuous pipe in the well, also called snubbing. In a coiled tubing intervention, a continuous tube initially wound on a spool is unwound, straightened and pushed down a hole. In order to do this various items of equipment are located in the area above the well, all supported on a common frame. A typical set-up involves, from top to bottom, a goose neck for guiding and straightening the coiled tubing as it is fed from the spool, an injector head for pushing the tubing into or pulling it out of the well, a stuffing box to form a seal around the tubing, and a blow out preventer. There may be additional components depending on specifics of the operation performed. The blow out preventer itself may consist of a number of components, such as a pipe ram, a slip ram, a shear ram and a blind ram.

Regarding coiled tubing well intervention being performed from a floating vessel in a sub sea well, before the coiled tubing can be fed into the well, it is necessary to prepare or rig up all the equipment on top of a riser, which is attached to the top of the well at the sea floor. The riser extends from the top of the well at the sea floor, up to the work-deck of the vessel. The intervention equipment is then rigged up in a frame, which supports the attachment of the intervention equipment to the riser. On floating drilling or well intervention vessels such as semi-submersible rigs, mono-hull vessels or similar, the frame structure also provides the necessary rigidity of the rig-up in order to enable the onboard heave compensating system to function efficiently. The heave compensating system enables the equipment attached to the well to move relative to the floating vessel in a controlled manner. The frame is usually installed by attaching the top of the frame to a hoist suspended from a tower above the well and then hoisting the frame into position above the well while transferring the frame from a horizontal to a vertical position above the well. The weight of the frame is carried by the hoist and tuggers are used to stabilise the frame laterally in position above the well. The various equipment items are then attached to the frame, whilst it is suspended above the well. During this rigging up sequence, other activity in the area above the well has to cease. Typically, the sequence can take 12 to 30 hours, or even longer when weather conditions are bad.

In the case of a wireline intervention a frame is similarly used to support equipment including a stuffing box, lubricator and a blow out preventer. A snubbing intervention, involving the use of pipe sections joined together rather than a continuous tubing or line, requires a snubbing unit to be supported in the area above the well.

Offshore well interventions are sometimes carried out from semi submersible rigs or ships. During the rigging up sequence, the rig or ship may be heaving due to weather conditions, making the rigging up more difficult, time consuming and hazardous. If the weather conditions and heave are particularly bad, then rigging and other preoperational activity may have to stop until calmer conditions prevail, in order to secure the safety of the operation.

SUMMARY

Viewed from a first aspect the invention provides well apparatus comprising a tower, and a support for supporting well intervention, completion, testing, or drilling equipment, the support being attached to the tower and being movable laterally from a parked position on the tower, where preparation of the equipment can be carried out without occupying an operational area where the equipment is to operate on the well, and an operational position in the operational area, and the support being arranged to be lowered or lifted, the apparatus further comprising a guide mechanism for guiding the support so that as the support is lowered or lifted it is guided along a path involving lateral movement from the parked position to the operational position in the operational area.

The first aspect of the invention also provides a method of executing well intervention, completion, testing or drilling, the method comprising preparing well intervention completion, testing or drilling equipment on a support attached to a tower whilst the support is in a parked position on the tower, so as not to occupy during said preparation an operational area where the equipment is to operate on the well, and moving the support laterally whilst it continues to be attached to the tower to an operational position in the operational area, wherein the support is moved laterally by being lowered or lifted, and by guiding the support so that as it is lowered or lifted it is guided along a path involving lateral movement from the parked position laterally of the operational area to the operational position in the operational area.

With such an apparatus and method it is possible to prepare the well intervention or other equipment when the support is in the parked position, leaving the operational area available for other operations, and leaving the access to the operational area open for moving equipment to and from the said area. In the case of a semi submersible vessel or a mono-hull vessel, by parking the support laterally of the operational area, it is no longer necessary for the preparation work to be performed above the well using man riding winches or the like. There is a significant health and safety advantage.

By carrying out the preparation work away from the operational area, the total time for occupying the operational area while carrying out the well intervention or other operation may be reduced, saving the well operator costs. Once the well intervention or other equipment has been prepared with the support in the parked position, then it can be transferred to the operational position. In the case of a mono-hull vessel, for example, preparation of the well intervention or other equipment can even be carried out when the vessel is docked, before it has sailed to the well. In this case the preparation can be carried out in calm conditions and the time that the vessel spends at the well can be kept to a minimum.

In one preferred method, therefore, the preparation of the equipment is carried out at a site remote from the well.

In certain known systems, when an operation on a well is to be carried out using a vessel subject to heave, the preparation of the equipment is carried out in the operational area, while the equipment is attached to the riser extending to the sea surface from a well head on the seabed. Hence, the equipment is moving relative to the vessel as the vessel heaves. In order to eliminate such relative movements during preparation of the equipment, a heave eliminating device is used during preparation of the equipment to compensate for relative movement between the vessel and the top of the riser. The heave eliminating device has a telescopic connection which is used to maintain the riser in communication with a surface valve on the vessel whilst the surface valve moves with the vessel as it heaves.

A preferred method of the present invention is carried out on a vessel subject to heave movement, wherein the equipment is to be attached to a riser extending from a well head at the seabed, and wherein the preparation is carried out on the equipment whilst the support has no movement relative to the vessel, without the use of a heave eliminating device between the riser and the equipment during said preparation. The use of such a method can avoid the cost of providing a heave eliminating device for use during the preparation of the equipment. Relative movement between the vessel and the top of the riser as a result of the vessel's movements need not be eliminated during the preparation. Exposure of personnel carrying out the preparation to such relative movement and the safety issues which arise can be avoided. Once the preparation of the equipment is complete then it can be attached to the winch of the vessel and this can be placed in a heave compensation mode, whereby the equipment then moves relative to the vessel in a manner to reduce or eliminate movement relative to the riser, allowing the equipment to be lowered into contact with the riser.

The invention may be useful for situations which do not involve vessels subject to heave, for example it can be used on land based oil or gas rigs or fixed offshore platform rigs. The invention contributes significantly to improve both efficiency and health and safety on fixed installations as well.

Examples of well intervention equipment which may be prepared in this way, in accordance with the first aspect of the invention, is coiled tubing, wire line, or snubbing equipment. The invention is also useful for preparing other types of equipment, such as completion, testing or drilling equipment.

The use of a system in which downward or upward (e.g. vertical) movement of the support, whether downward under its own weight or upwards when being lifted by a lifting means or mechanism, to obtain a guided movement (including a lateral component) to the operational position, can improve efficiency and safety. Simply by lowering or lifting the support the desired lateral movement to the operational position is obtained in a guided manner. The lateral movement can be effected as a result of the lowering or lifting.

Preferably the support has the same orientation when in the parked position as when in the operational position. For example it can be maintained in a substantially constant orientation during the lateral movement. This can enable the equipment to be prepared or worked on when the support is in the parked position with the equipment in the same orientation as that in which it will be used when the support is in the operational position.

The support is preferably arranged to be located outwardly of the tower when in the parked position. The arrangement may be such that the support is outwardly of and adjacent to the tower. Thus the equipment may be easily accessed whilst leaving the operational area clear of obstruction by the support or the equipment.

The support may be in the form of a support frame. The support may be provided with at least one platform, and preferably also with stairs, in order to facilitate the preparation of the well intervention or other equipment. In the arrangement in which the support has the same orientation when in the parked position as when in the operational position, the platform and/or stairs can advantageously be appropriately orientated in both positions. The support is preferably arranged to permit the equipment to be rigidly secured to the support. The equipment can thus be secured to the support when it is in the parked position and retained in a secure condition during movement of the support to the operational position.

The guide mechanism may be arranged so that the support follows a predefined path from the parked position to the operational position. The movement along a path from the parked position to the operational position can be controlled. For example, the movement can be controlled to maintain the orientation of the support in the same position, e.g. a vertical position, during the movement. Preferably the operational position is in a predetermined vertical plane, whereby the apparatus automatically positions the support in the correct position in the operational area, e.g. centrally above the well. Thus the apparatus and method may combine the functions of moving the well intervention or other equipment laterally and centralising it, avoiding the use of tuggers or the like for centralisation.

After the equipment has been used in the operational area it will usually be desired to return the support to the parked position. The support is therefore preferably also arranged to be guided during movement from the operational position to the parked position.

The guide mechanism may take various forms, for example the form of a laterally extending guide rail or track. Preferably, the support follows an arcuate path between the parked and operational positions. It may be pivotally mounted to the tower, preferably for pivoting about a horizontal axis.

The guide mechanism may be arranged so that when the support moves downwardly, it is guided with a movement which has a downward component and a lateral component. The guide mechanism may be arranged so that when the support moves upwardly, it is guided with a movement which has an upward component and a lateral component. In one possible arrangement, the support moves only upwardly and laterally from the parked position to the operational position. Thus for example the support may be in a lowermost condition when in the parked position. In the case of the arcuate movement, the support may follow an upward arcuate path. In another arrangement, the guide mechanism involves both a downward movement and an upward movement during the transfer from the parked position to the operational position The support may first move downwardly and laterally and then upwardly and laterally as it moves from the parked position to the operational position. Alternatively, the support may first move upwardly and laterally and then downwardly and laterally as it moves from the parked position to the operational position. Both of these sequences are possible for example in the case where the support follows an arcuate path between the parked and operational positions.

The guide mechanism preferably comprises an arm pivotally mounted on the tower. The arm may be arranged to pivot about a horizontal axis as the support is guided from the parked position to the operational position, so that when the arm has completed the pivoting about the horizontal axis it extends laterally over the operational area.

In a preferred arrangement, upper and lower arms are provided. The guide mechanism preferably comprises an upper arm pivotally mounted on the tower and a lower arm pivotally mounted on the tower below the upper arm. The upper and lower arms may be pivotally mounted to the tower at one side of an opening in the tower through which the support can move between the parked and operational positions. Thus the upper and lower arms, when viewed from above in plan view, may extend at an angle to the plane of pivotal movement. This allows the support to move between the parked and operational positions whilst keeping clear of the part of the tower to which the arms are mounted. There is preferably a pair of upper arms and a pair of lower arms. One arm of each pair may be pivotally mounted to the tower at one side of the opening therein, whilst the other arm of each pair may be pivotally mounted to the tower at the other side of the opening.

Preferably, the apparatus is arranged to lock the support in the operational position so that lateral movement of the support relative to the tower is prevented. Suitable locking means may therefore be provided. Thus the support may be held in a stable manner relative to the tower, without the use of tuggers or other lateral stabilising means. Where the guide mechanism includes upper and lower arms as discussed above, these may adopt a locked position when they are pivoted to their maximum extent into the operational area. Considering the situation when the tower is vertical, this will be a horizontal condition of the arms.

Preferably a trolley is provided, mounted to the tower and moveable up or down the tower, preferably vertically. The support is then preferably mounted to the trolley, preferably via the guide mechanism discussed above. The trolley may therefore provide a link between the support and the tower. The trolley is preferably arranged to move up and down in vertical rails. It may be provided with wheels or rollers to facilitate its movement. The trolley may be temporarily locked to the rails, for instance by means of locking pins, in such a way that the trolley is temporarily prevented from moving vertically during movement of the support from the parked position to the operational position. Thus the support may move along the preferred arcuate path e.g. as vertical forces are induced onto the support frame. Where the preferred guide mechanism is used, this provides for the support to move along a predetermined path between the parked and operational positions, and this path may be at different vertical positions depending on particular local requirements.

In the case of a ship or semi submersible vessel subject to heave, when in the operational position, the trolley may act as a sliding connection between the support with the intervention or other equipment and the vertical rails in the tower, providing horizontal stability and rigidity to the support as it moves vertically relative to the tower due to the vessel's heave movements.

A lifting means is preferably provided to impart vertical movement to the support during its movement from the parked position to the operational position. Such lifting means may also impart vertical movement to the support during its return movement from the operational position to the parked position. The lifting means can provide the necessary power to effect the desired movements, preferably under the guidance of the guide mechanism. Thus the lifting means can cause the movement to take place.

In one preferred arrangement, the support is attached to a hoist which bears the weight of the support during said movement from the parked position to the operational position. The hoist may also bear the weight of the support during the return movement from the operational position to the parked position. In the case of a floating vessel, when in the operational position, the hoist winch may also provide the heave compensating movements relative to the vessel. The support preferably comprises an attachment portion for attachment to such a hoist. It is normal in gas or oil wells for there to be a hoist above the well which is able to take considerable loads. Thus, according to the preferred feature of the first aspect of the invention involving the use of a hoist, the system can benefit from the availability of the hoist and avoid involving additional heavy equipment to cause the movement of the support between the parked and operational positions.

The hoist is preferably carried by the tower. The hoist will normally include a sheave from which a cable is suspended. In one type of arrangement the hoist may be in a fixed lateral location, generally above the operational area. This arrangement works well in the case where the movement from the parked position to the operational position involves a vertical and lateral movement. The hoist can then lift or lower the support as it moves from the parked to the operational position and then lower or lift it respectively when it is desired to return the support to the parked position. In another arrangement, the hoist is moveable laterally on the tower. Thus it can be located directly above the support whether it is in the operational or the parked position. It may for example be moveable between a location above the operational position of the well and a location displaced laterally outwardly of the tower. A sheave of the hoist may thus be arranged to skid horizontally on the tower.

In an alternative arrangement, a jacking system, a hydraulic cylinder or cylinders, or the like, may be provided to cause the movement of the support between the parked and operational positions. Thus for example a jacking system may be attached to the support to bear the weight of the support and the well intervention, completion, testing, or drilling equipment during said movement from the parked position to the operational position. It may also bear the weight during the return movement from the operational position to the parked position.

In addition, in the operational position, the total load of support (e.g. support frame), intervention or other equipment, riser and any induced forces, may be supported by the jacking system installed e.g. on the work deck and attached to the support. The jacking system may be located below the support and push up against the lower part thereof. Such a jacking system may also comprise a heave compensation system.

In fact, the combination of the use of a lifting means and guiding a load laterally is of independent patentable significance.

Viewed from a second aspect, the invention provides a method of transferring a load laterally into an operational area where the load is to operate on a well, the method comprising using a lifting mechanism to lower or lift the load, and guiding the load so that when the load is lowered or lifted it is guided along a path involving lateral movement from a position laterally of the operational area to a position in the operational area.

The second aspect of the invention also provides apparatus for transferring a load laterally into an operational area where the load is to operate on a well, comprising a lifting mechanism to lower or lift the load, and a guide mechanism for guiding the load so that when the load is lowered or lifted it is guided along a path involving lateral movement from a position laterally of the operational area to a position in the operational area.

The second aspect of the invention may be useful in the context of semi submersible rigs and mono-hull vessels, where the load has to be transferred in heaving conditions also involving roll, pitch and yaw movements. It is also applicable to fixed offshore oil and gas rigs as well as land rigs. The use of a system in which downward or upward (e.g. vertical) movement of a load, whether downward under its own weight or upwards when being lifted by a lifting means or mechanism, to obtain a guided movement including a lateral component, can improve efficiency and safety.

As discussed above, downward or upward movement can be induced by a hoist acting from above the load e.g. support frame, or by a jacking system attached to the load, for example installed below and pushing up against the load.

Viewed from a third aspect, the invention provides well apparatus comprising a tower, a support for supporting well intervention, completion, testing, or drilling equipment, the support being attached to the tower and being movable laterally from a parked position, where preparation of the equipment can be carried out without occupying an operational area where the equipment is to operate on the well, and an operational position in the operational area.

The third aspect of the invention also provides a method of executing well intervention, completion, testing or drilling, the method comprising preparing well intervention completion, testing or drilling equipment on a support attached to a, tower whilst the support is in a parked position, so as not to occupy during said preparation an operational area where the equipment is to operate on the well, and moving the support laterally whilst it continues to be attached to the tower to an operational position in the operational area.

The various features discussed above in relation to the first aspect of the invention are also applicable to the second and third aspects, individually and in any combination. Guiding may for example be carried out by the guide mechanism discussed above.

BRIEF DESCRIPTION OF THE DRAWINGS

Certain preferred embodiments of the invention will now be described by way of example and with reference to the accompanying drawings in which.

DETAILED DESCRIPTION OF VARIOUS EMBODIMENTS OF THE DISCLOSURE

Figure 1:
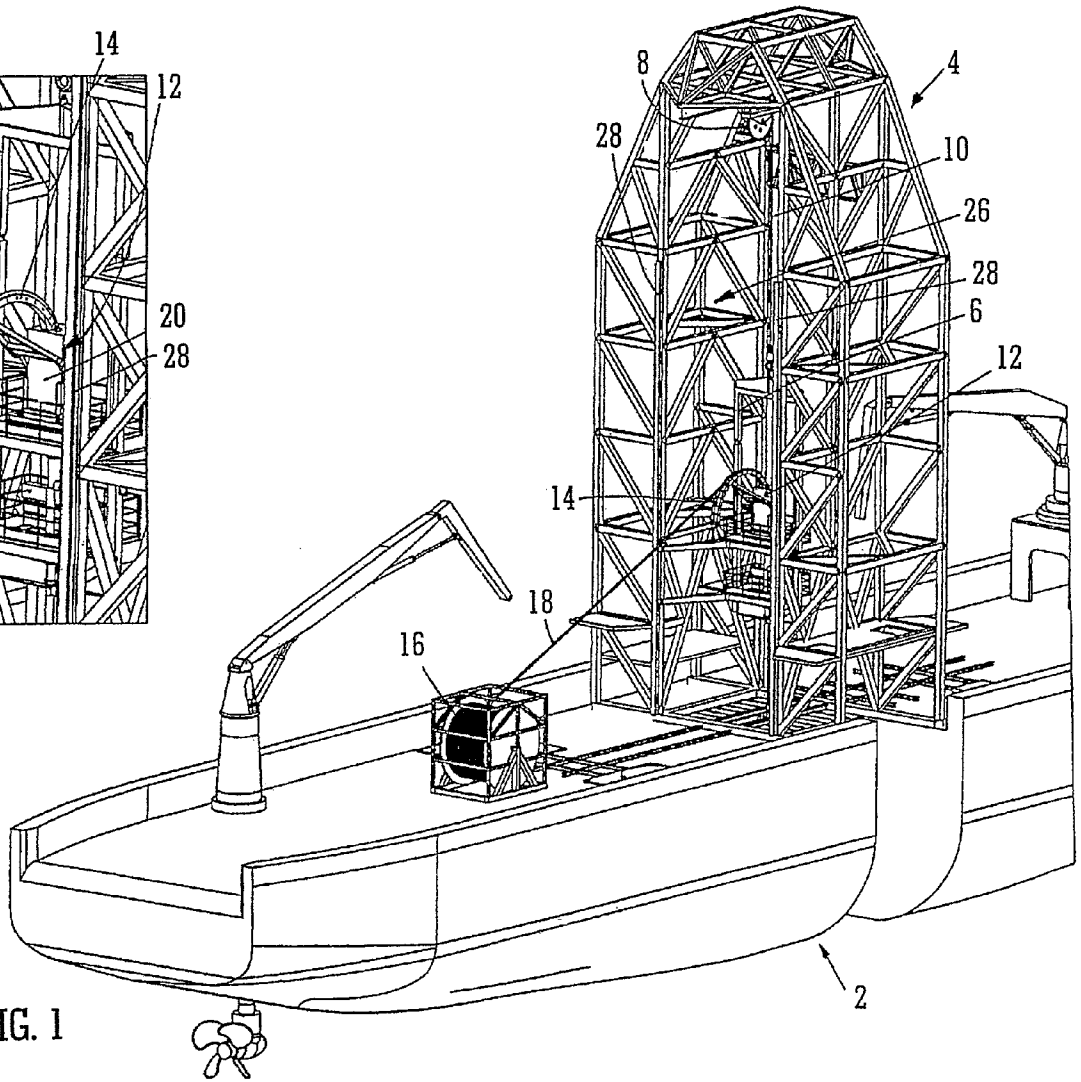
FIG. 1 is a perspective view of well intervention apparatus according to the invention provided on a ship.

FIG. 1 shows a mono-hull vessel or ship 2 on which is located a tower 4 above a moon pool (not shown). A support frame 6 is located centrally above the moon pool and is attached at its upper end to a hoist 8 having a cable 10. Well intervention equipment 12 is mounted on the support and includes a gooseneck 14. A spool 16 of coiled tubing 18 is supported on the deck of the ship 2. The coiled tubing passes round the gooseneck 14 via the rest of the well intervention equipment and through the centre of the riser (not shown) in the centre of the moon pool towards a well below the ship.

Figure 2:
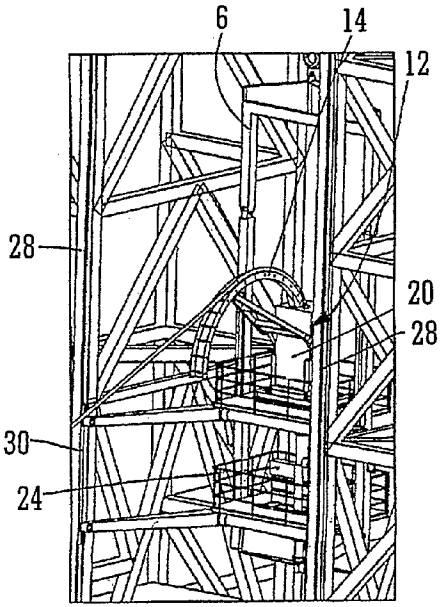
FIG. 2 is an enlarged perspective view of part of the well intervention apparatus provided on the ship.
Figure 3:
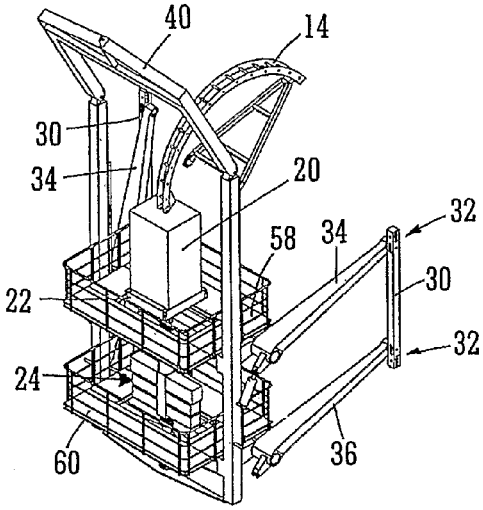
FIG. 3 is an isometric view of the well intervention apparatus carrying well intervention equipment.
Figure 4:
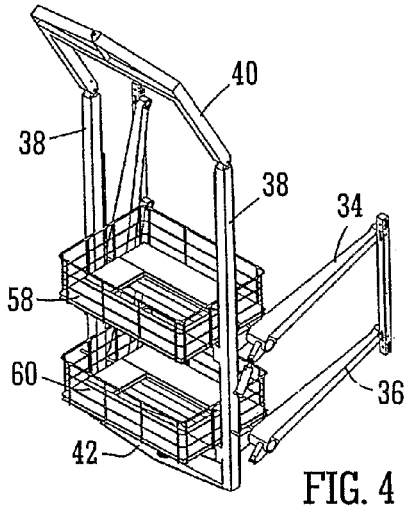
FIG. 4 is an isometric view of the well intervention apparatus without any well intervention equipment in place.

Referring to FIG. 3 as well as FIGS. 1 and 2, the well intervention equipment includes, from the gooseneck 14 downwardly, an injector head 20, a stuffing box or stripper 22 and a blowout preventer 24. The gooseneck 14, the injector head 20, the stripper or stuffing box 22 and the blowout preventer 24 are all carried by the support frame 6 in an integrated manner. The support frame therefore provides an integrated lifting frame. Alternatively, a Surface Flow Tree (not shown) might also be carried at the lower part of the support frame.

The tower 4 is provided with an opening 26 though which the support frame and the equipment which it carries can be moved from a position generally at the side of the area above the moon pool into a centralised position above the centre of the moon pool, the latter position being shown in FIGS. 1 and 2. The tower 4 has a vertical rail 28 on each side of the opening 26. In each rail a cursor 30 is arranged so as to be vertically moveable into different vertical positions on the tower, whilst being lockable to the rails by locking means (not shown). Each cursor 30 is provided at its upper and lower ends with rollers 32 facilitating up and down vertical movement along the rails 28. The pair of cursors 30 on opposite sides of the opening 26 together form a vertically moveable trolley.

Further details of the well intervention apparatus will be described with reference to FIGS. 3-6. At the upper end of each cursor 30 an upper arm 34 is pivotally mounted to rotate about a horizontal axis. Similarly, at the lower end of each cursor 30 a lower arm 36 is pivotally mounted to rotate about a horizontal axis. The support frame 6 consists of a pair of vertically extending side beams 38 each pivotally connected at its top end to a lift yoke 40. The lower ends of the side beams 38 are interconnected by a horizontal beam 42 provided centrally thereof with a removable cylindrical aperture 44 for passage of the coiled tubing 18. The cylindrical aperture 44 may provide a connection to a surface flow tree or a riser pup flow tee. There may be one or more valves built into the lower end of the support frame.

Each side beam 38 is provided with a pair of vertically spaced lugs 46 which project laterally from the side beam 38 away from the central area of the tower. The lugs 46 are pivotally connected to the ends of the support beams 34 and 36 remote from their ends which are pivotally mounted on the cursors 30.

Figure 5:
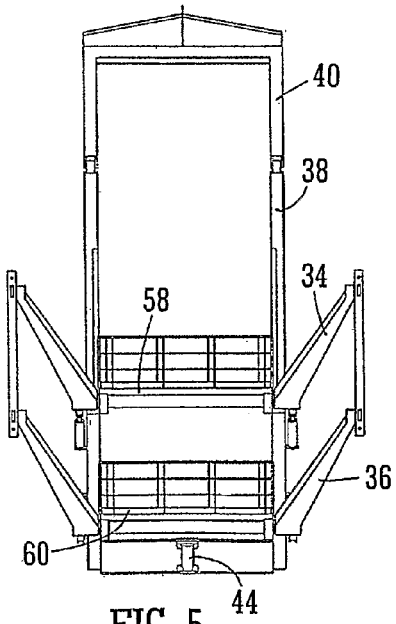
FIG. 5 is a front elevation view of the well intervention apparatus.
Figure 6:
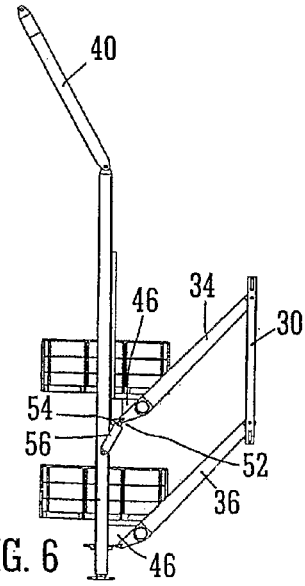
FIG. 6 is a side elevation view of the well intervention apparatus.
Figure 6A:
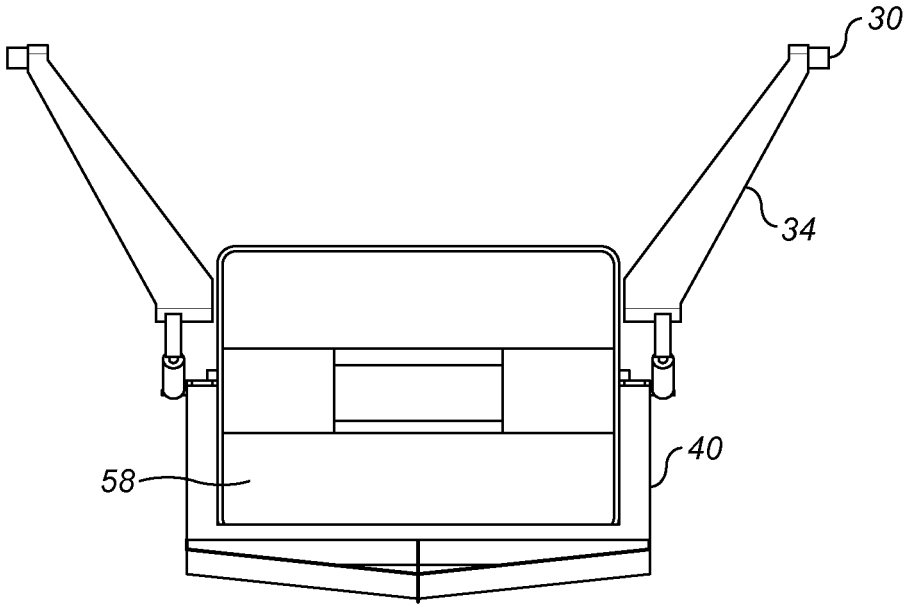

As particularly seen in FIG. 5, the pair of upper support arms 34 extend inwardly from the cursors 30, as do the lower support arms 36, so that the support frame 6 is cradled by the pair of upper support arms and pair of lower support arms. When viewed from above in plan view, the upper and lower support arms extend at an angle to the plane of pivotal movement. Each upper arm 34 extends away from its respective cursor 30 beyond its pivotal mounting to the lug 46 to a distal end 52 where it is pivotally mounted to a locking piston 54. The piston 54 is received in a cylinder 56 which is pivotally supported on the side beam 38 of the support frame 6.

The support frame 6 is provided with an upper work platform 58 and a lower work platform 60, each work platform extending between the side beams 38 and extending all the way round the well intervention equipment 12. This provides for easy access to the equipment from all sides.

Figure 7:
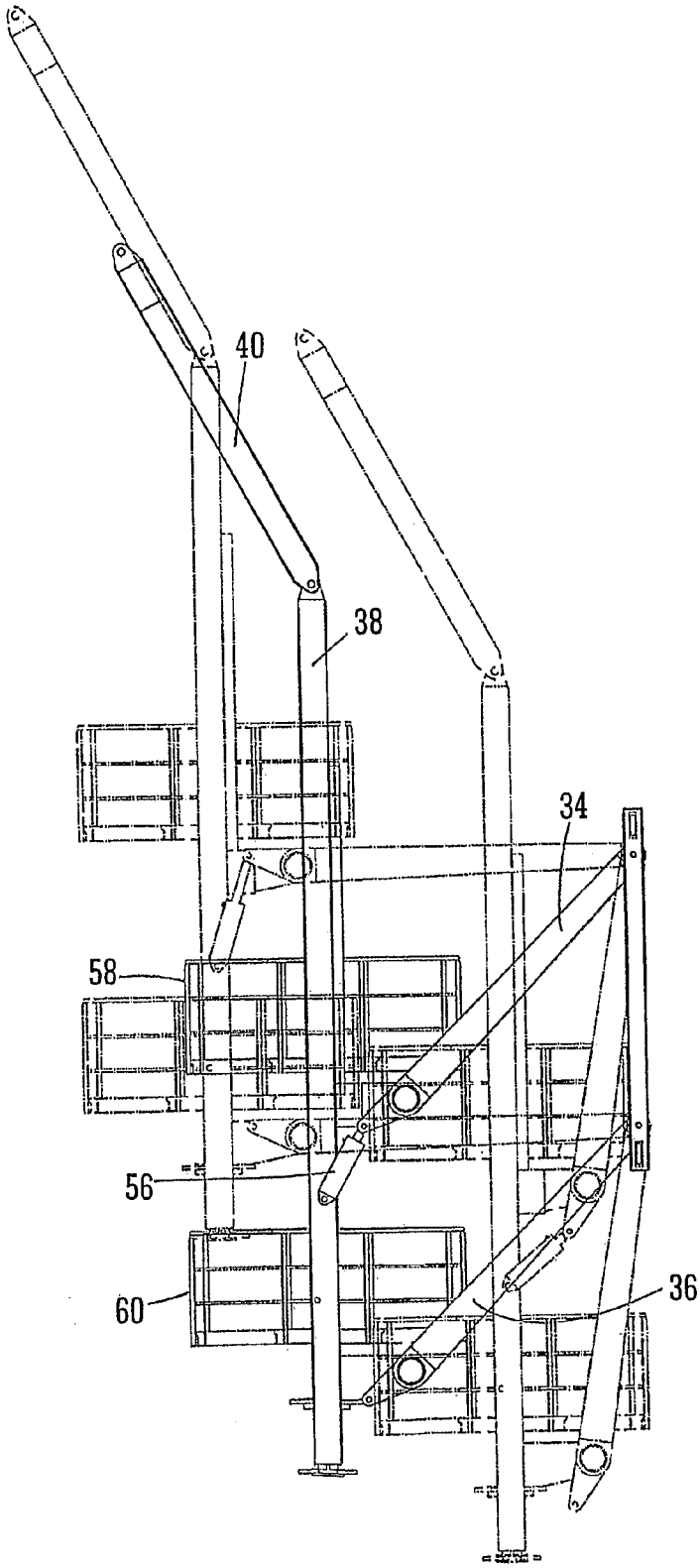
FIG. 7 is a side elevation view of the well intervention apparatus showing it in a parked position, an intermediate position and an operational position.
Figure 10:
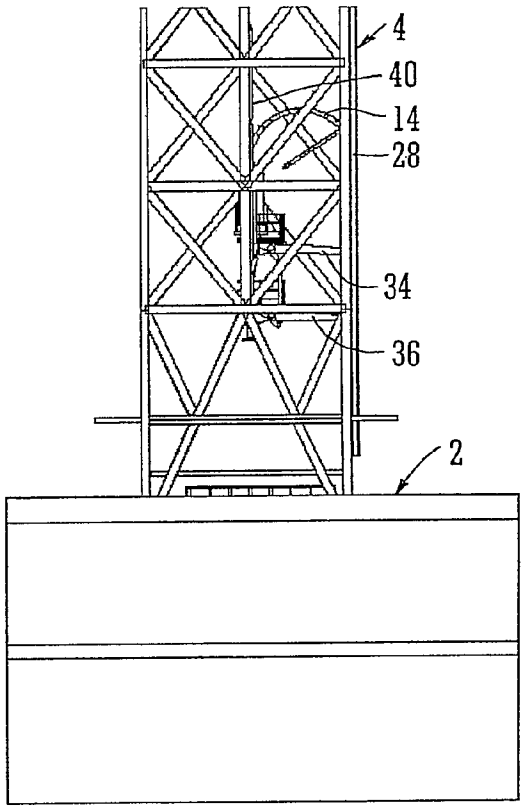
FIGS. 8, 9 and 10 are side elevation views of well intervention apparatus on a ship and showing the apparatus respectively in parked, intermediate and operational positions.
Figure 9:
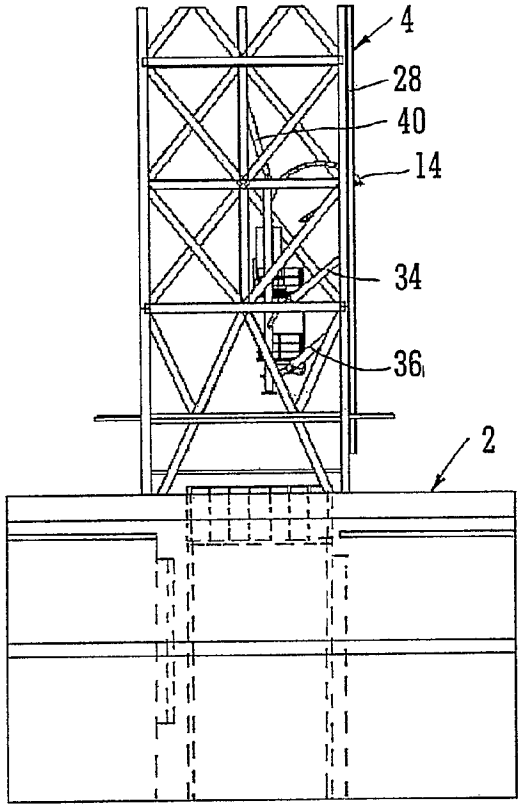
Figure 8:
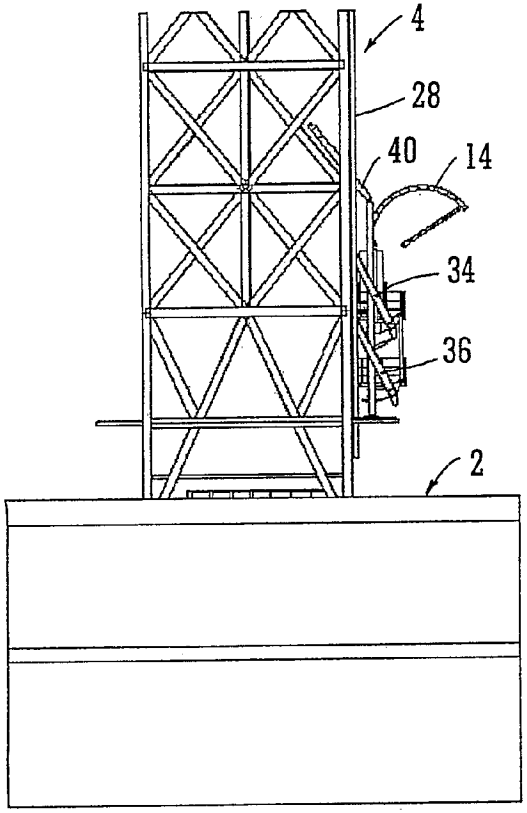

FIGS. 8-10 show the support frame 6 in three different positions. For clarity, the work platforms 58 and 60 are only partly shown in these figures. FIGS. 8-10 show the support frame when it is carrying the well intervention equipment. FIG. 8 shows the support frame in a parked position, FIG. 9 shows it in an intermediate position and FIG. 10 shows it in an operational position. FIG. 7 shows the apparatus with the well intervention equipment omitted for clarity. FIG. 7 shows, at its left hand side, and in chain dotted lines, the support frame 6 in its operational position. In solid lines, in the middle of FIG. 7, the support frame is shown at an intermediate position corresponding to that of FIG. 9. In chain dotted lines in FIG. 7 the support frame is shown in another intermediate position, nearer to the parked position The movement of the support frame 6 from the parked position to the operational position will now be described. In the initial position of FIG. 8, the lifting yoke 40 is attached by a hook or the like to the hoist 8 (as seen in FIG. 1). The cursors 30 are locked to their respective rails 28, so that they cannot move vertically along the rails either up or down. In this parked position, the well intervention equipment 12 may be attached to the support frame 6 whilst leaving the area above the moon pool free of obstruction and available for other activities. When preparation of the equipment, in this case coiled tubing equipment (although as mentioned elsewhere other equipment such as wire line or snubbing equipment may require to be prepared), is completed, the hoist 8 pays out cable 10 and allows the support frame and the equipment it carries to start to swing downwardly. Alternatively, an externally mounted crane hoist 62 may be utilized until the support frame reaches its lowermost position (see FIG. 12). During this movement the apparatus follows an arcuate path, having a downward component and also a lateral component towards the moon pool. The path is defined by the parallelogram linkage arrangement of the upper and lower pairs of support arms 34 and 36, whereby the support frame and the supported equipment maintains the same orientation, in this case a vertical orientation, at all times. As the support frame moves laterally over the moon pool area the lifting yoke 40 pivots relative to the side beams 38. After the support frame has reached its lowermost position, when the upper and lower support arms 34 and 36 are in line with the cursors 30, the hoist 6 stops paying out cable 10 and starts hauling it in, so that the support frame and the carried equipment start to be lifted, continuing along the arcuate path but now having an upward vertical component as well as a lateral component. When the upper and lower support arms 34 and 36 reach a horizontal position, the support frame is in the centre of the tower, with its cylindrical opening aligned with the moon pool centre. At this point the locking cylinder 56 locks the apparatus in this centred position and the well intervention operation can begin.

In FIGS. 11-14 the centre line 70 of the moon pool is shown.

Figure 11:
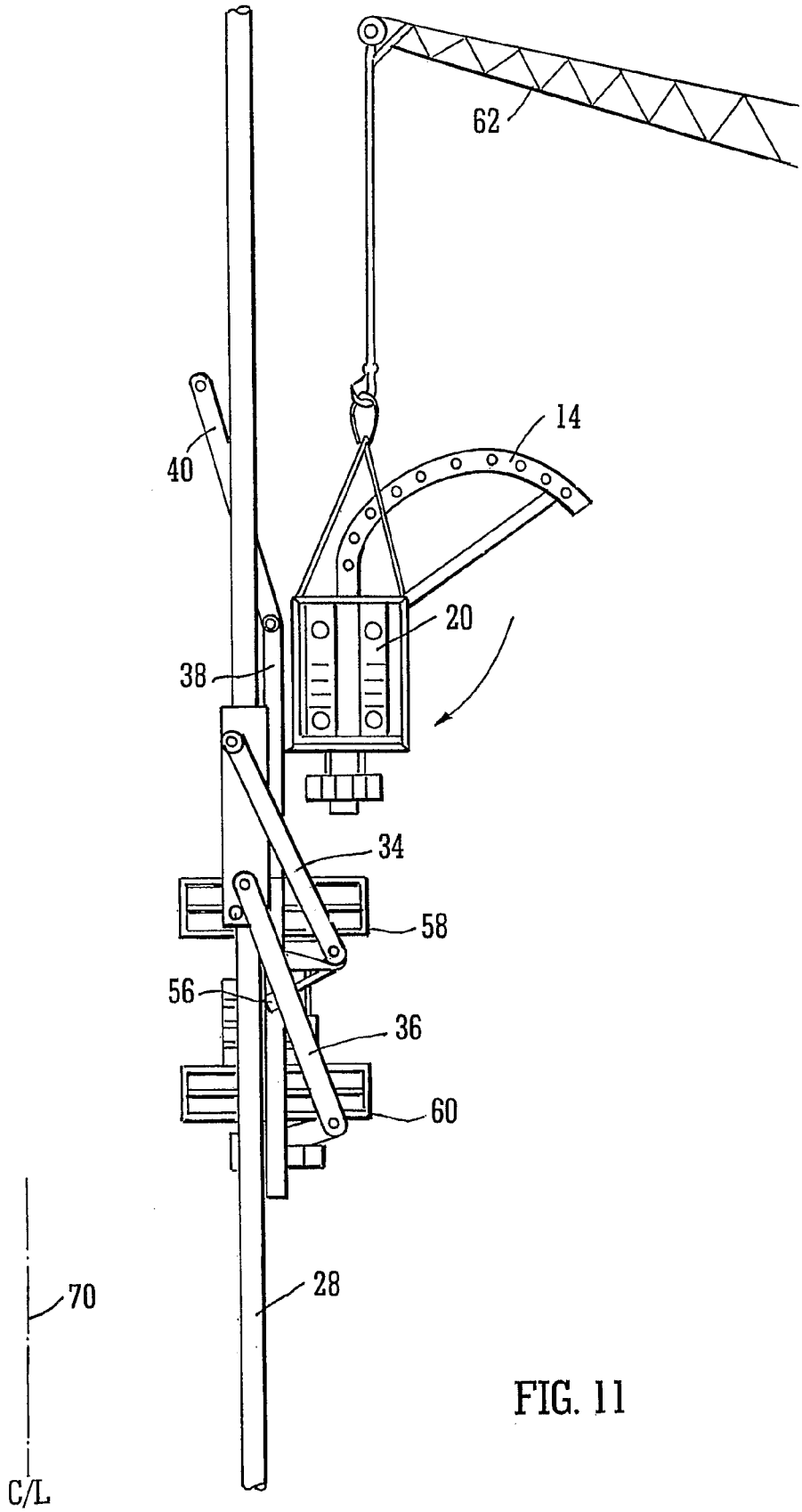
FIG. 11 is a sketch showing well intervention apparatus according to the invention in side elevation in the process of having an item of well intervention equipment loaded and installed thereon.

FIG. 11 shows the use of a ship's crane 62 lowering the gooseneck and injector head into position on the support frame. All other equipment to be rigged up in the support frame, can be installed the same way. This is part of the rigging up operation which can be carried out when the support frame is in the parked position. The crane 62 may alternatively be a crane at the quay-side, rather than the ship's crane.

Figure 12:
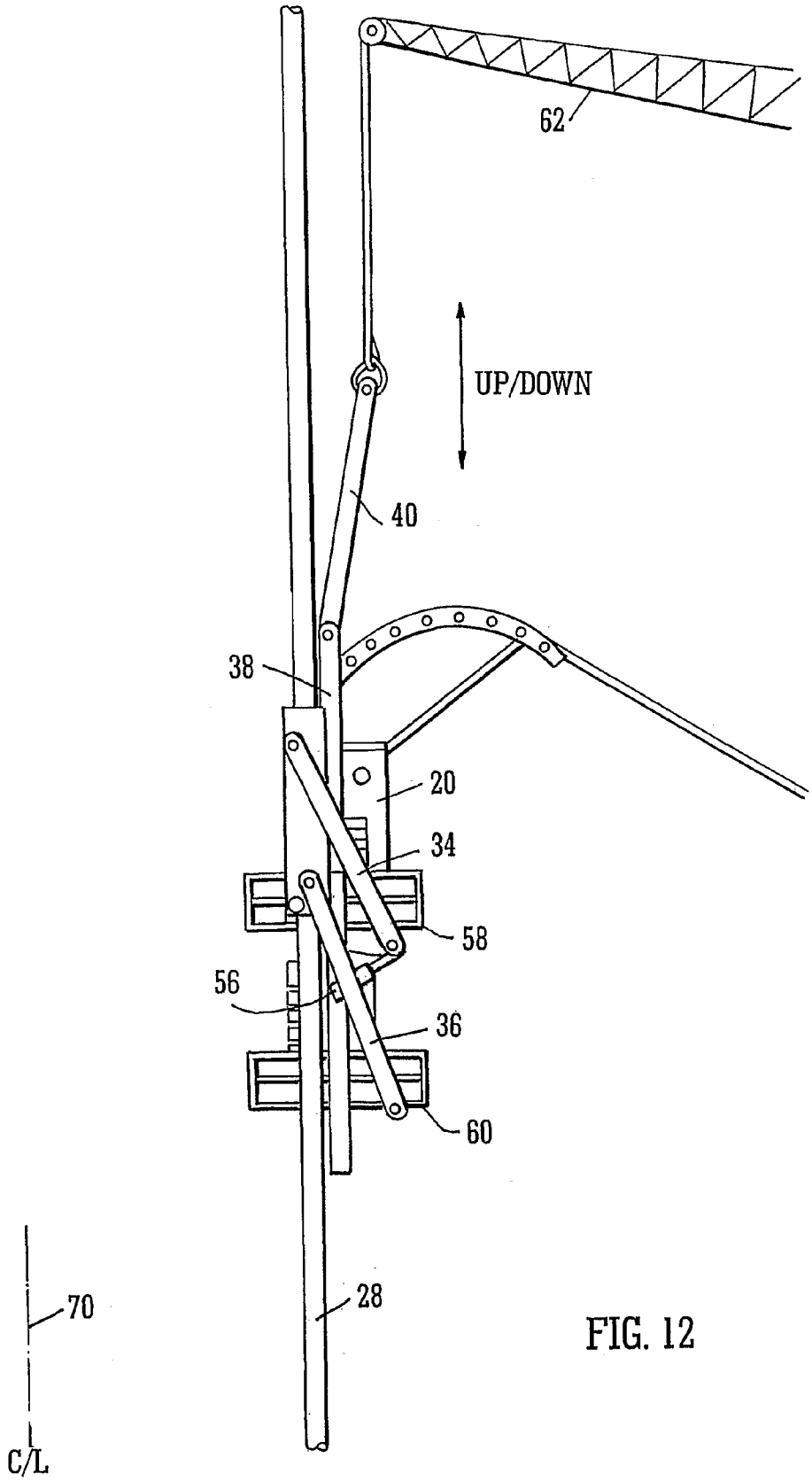
FIG. 12 is a sketch showing the well intervention apparatus of FIG. 11 being lifted or lowered between different vertical positions on a tower.
Figure 13:
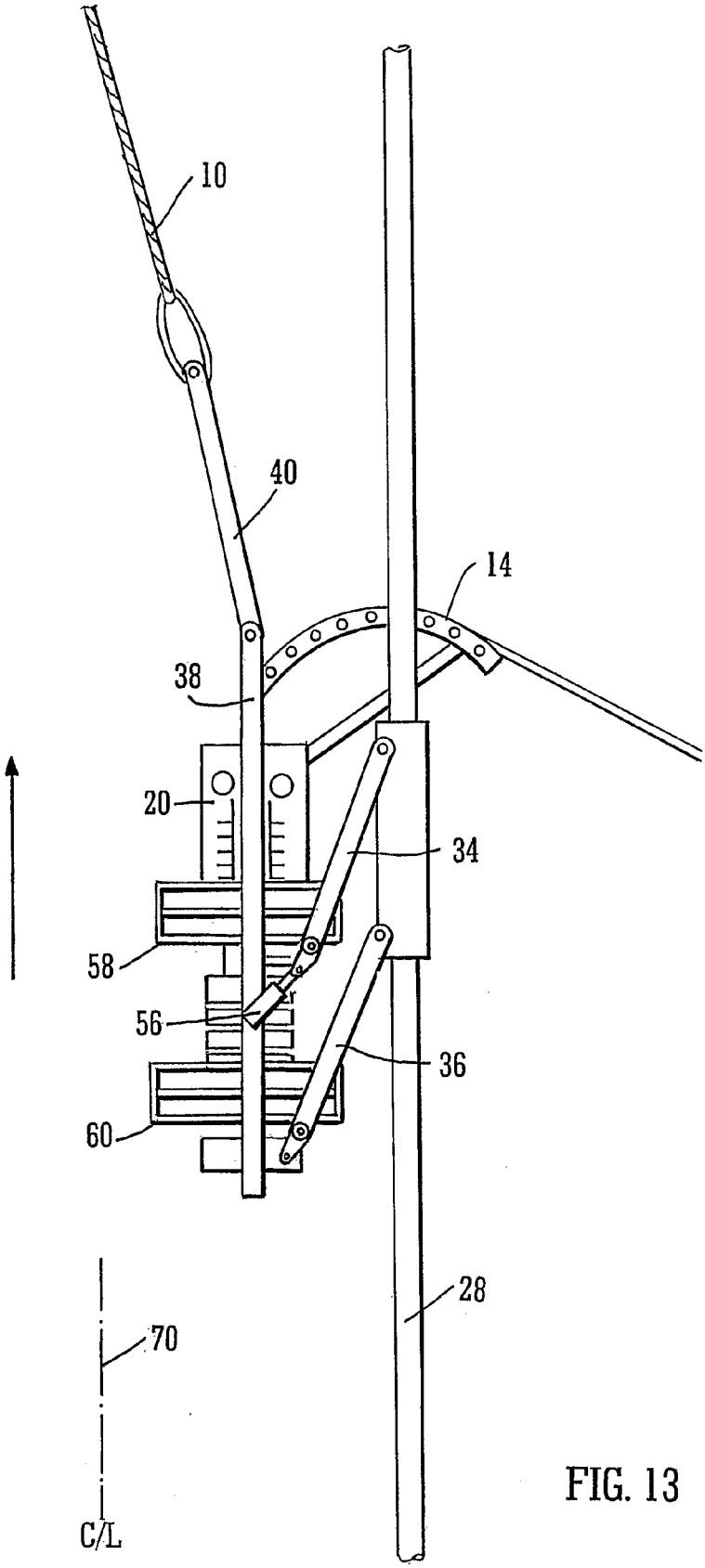
FIG. 13 is a sketch showing a side elevation of the well intervention apparatus of FIG. 11 transferred into an intermediate position.
Figure 14:
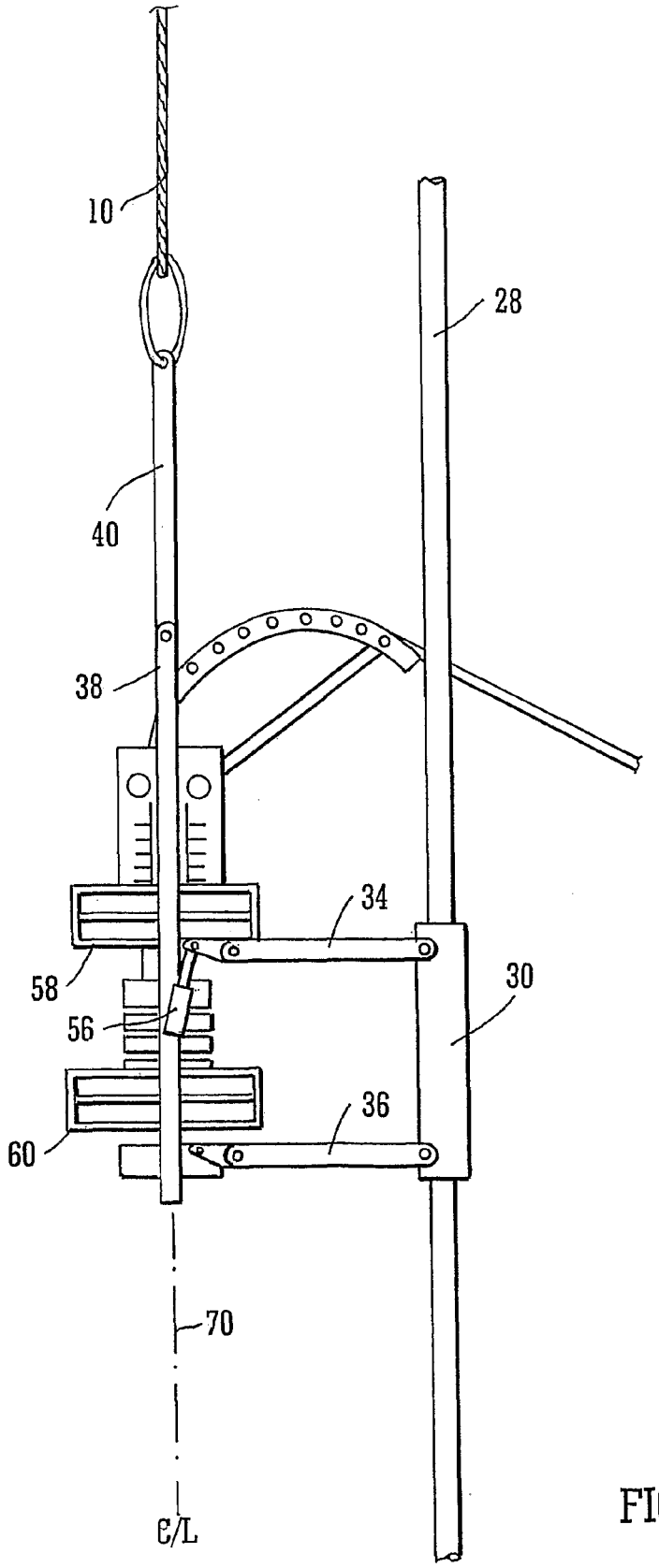
FIG. 14 is a sketch of a side elevation view of the well intervention apparatus of FIG. 11 having been transferred into the operational position.

As seen in FIG. 12, the ship's or quay-side crane 62 may be used to position the cursors in different vertical positions, as required. As seen in FIG. 13, the lifting yoke 40 may be detached from the crane 62 and attached to the hoist 8 carried by the tower. As described in relation to FIGS. 7-9, the hoist 8 can then provide a controlled lowering followed by lifting of the support frame and equipment, in order to move the system into the operational position shown in FIG. 14.

In the embodiments as described, the apparatus makes use of the available lifting equipment to move from the parked position to the operational position and does not require a separate built in source of power, such as for example a hydraulic system in order to achieve the desired lowering and lifting.

When it is desired to move the apparatus back from the operational position to the parked position, the hoist 8 pays out the cable 10 to allow the support arms 34 and 36 to move to the vertical position, parallel to the cursors 30. The hoist 8 may then be disconnected from the lifting yoke 40 and a ship's or other crane may be attached to the lifting yoke 40 in order to fully retract the apparatus into the parked position.

It will be appreciated that the above embodiments relate to supporting and moving coiled tubing equipment, but that the support frame can be used to support and move other types of equipment for well intervention, completion, testing or drilling. In addition, the support frame, or an appropriately modified support, could be used to carry and move other loads between a position at the side of an area above a well and a position above a well. Indeed, a support as such may not be needed, and a load can be carried directly by the guide mechanism. All of these variations are within the scope of the invention in its various aspects.

The invention claimed is:

1. Well apparatus comprising:

a tower having sides and having vertical rails, two of said vertical rails defining an opening at one of said sides of the tower providing access to an internal operational area of the tower, a support for supporting well intervention, completion, testing, or drilling equipment, said support being attached to the tower and being movable laterally from a parked position on the tower, wherein in said parked position, said support does not occupy said operational area where the equipment is to operate on the well to allow the preparation of the equipment, and an operational position in the operational area, wherein the support is arranged to be lowered or lifted, and a guide mechanism for guiding the support so that as the support is lowered or lifted, the support is guided along a path involving lateral movement from the parked position to the operational position in the operational area, wherein the guide mechanism for guiding the support comprises a pair of upper arms pivotally mounted on the tower and a pair of lower arms pivotally mounted on the tower below the upper arms, and wherein one arm of each pair of arms is pivotally mounted to one of the vertical rails defining the opening, and the other arm of each pair of arms is pivotally mounted to the other of the vertical rails defining the opening thereby enabling the support to move between the parked and operational positions through the opening.

2. The well apparatus as claimed in claim 1, wherein the support has the same orientation when in the parked position as when in the operational position.

3. The well apparatus as claimed in claim 1, wherein the guide mechanism is arranged so that when the support moves downwardly, it is guided with a movement which has a downward component and a lateral component.

4. The well apparatus as claimed in claim 1, wherein the guide mechanism is arranged so that when the support moves upwardly, it is guided with a movement which has an upward component and a lateral component.

5. The well apparatus as claimed in claim 1, wherein the support is pivotally attached to the tower.

6. The well apparatus as claimed in claim 1, wherein the upper and lower arms, when viewed from above in plan view, extend at an angle to the plane of pivotal movement.

7. The well apparatus as claimed in claim 1, wherein the guide mechanism is arranged to guide the support between the operational position and the parked position.

8. The well apparatus as claimed in claim 1, further comprising a lifting mechanism for lowering or lifting the support.

9. The well apparatus as claimed in claim 8, wherein the lifting mechanism is a hoist and wherein the support comprises an attachment portion for attachment of the hoist to the support to bear the weight of the support and the well intervention, completion, testing, or drilling equipment during said movement from the parked position to the operational position.

10. The well apparatus as claimed in claim 8, wherein the lifting mechanism is a jacking system attached to the support to bear the weight of the support and the well intervention, completion, testing, or drilling equipment during said movement from the parked position to the operational position.

11. The well apparatus as claimed in claim 1, wherein the pair of upper arms further comprises at least one locking piston pivotally coupled to each of the upper arms so that the pivotally mounted upper and lower arms are pivotally connected to the support thereby enabling the support to move between the parked and operational positions through the opening.

12. A method of executing well intervention, completion, testing or drilling, the method comprising:

preparing well intervention completion, testing or drilling equipment on a support attached to a tower while the support is in a parked position on the tower, the tower having sides and having vertical rails, two of said vertical rails defining an opening at one of said sides of the tower providing access to an internal operational area of the tower, wherein in said parked position, said support does not occupy said internal operational area of the tower where the equipment is to operate on the well during said preparation, and moving the support laterally while it continues to be attached to the tower to an operational position in the operational area through the opening at one side of the tower to provide access to said internal operational area, wherein the support is moved laterally by being lowered or lifted, and by guiding the support so that as it is lowered or lifted it is guided along a path involving lateral movement from the parked position laterally of the operational area to the operational position in the operational area, wherein the guiding is effected by a guide mechanism comprising a pair of upper arms pivotally mounted on the tower and a pair of lower arms pivotally mounted on the tower below the upper arms, and wherein one arm of each pair of the upper and lower arms is pivotally mounted to one of the vertical rails defining said opening and the other arm of each pair of arms is pivotally mounted to the other of the vertical rails defining the opening thereby enabling the support to move between the parked position and the operational position through the opening.

13. The method as claimed in claim 12, wherein the support has the same orientation when in the parked position as when in the operational position.

14. The method as claimed in claim 12, wherein the guided movement of the support from the parked position to the operational position includes an upward component as well as a lateral component.

15. The method as claimed in claim 12, comprising pivoting the support on the tower to effect the lateral movement.

16. The method as claimed in claim 12, wherein the support is attached to a hoist which bears the weight of the support and the equipment during said movement from the parked position to the operational position.

17. The method as claimed in claim 12, wherein the support is attached to a jacking system which bears the weight of the support and the equipment during said movement from the parked position to the operational position.

18. The method as claimed in claim 12, wherein the preparation of the equipment is carried out at a site remote from the well.

19. The method as claimed in claim 12, carried out on a vessel subject to heave movement, wherein the equipment is to be attached to a riser extending from a well head at the seabed, and wherein the preparation is carried out on the equipment whilst the support has no movement relative to the vessel, without the use of a heave eliminating device between the riser and the equipment during said preparation.

20. The method as claimed in claim 12, wherein the guided movement of the support from the parked position to the operational position includes a downward component as well as a lateral component.

21. The method as claimed in claim 12, wherein the guided movement of the support from the parked position to the operational position includes an upward component and a downward component as well as a lateral component.

22. The method as claimed in claim 21, wherein the support is moved first downwardly while moving laterally and then upwardly while moving laterally as it moves from the parked position to the operational position.

* * * * *